US005456465A

United States Patent [19]

Durham

[11] Patent Number: 5,456,465

[45] Date of Patent: Oct. 10, 1995

[54] METHOD FOR DETERMINING PAYOFFS IN REEL-TYPE SLOT MACHINES

[75] Inventor: Timothy J. Durham, Oak Park, Ill.

[73] Assignee: WMS Gaming Inc., Chicago, Ill.

[21] Appl. No.: 246,791

[22] Filed: May 20, 1994

[51] Int. Cl.[6] ..... G07F 17/34

[52] U.S. Cl. ..... 273/138 A; 273/143 R

[58] Field of Search ..... 273/433, 138 A, 273/143 R, 85 CP

[56] References Cited

U.S. PATENT DOCUMENTS 4,772,023 9/1988 Okada ..... 273/143 R 5,169,147 12/1992 Hamano ..... 273/143 R 5,205,555 4/1993 Hamano ..... 273/143 R 5,380,008 1/1995 Mathis et al. ..... 273/143 R

*Primary Examiner*—Benjamin H. Layno

*Attorney, Agent, or Firm*—Rockey, Rifkin and Ryther

[57] ABSTRACT

A method is disclosed for operating a microprocessor based reel-type slot machine. The payoff is randomly determined before any symbols are displayed. Two or more multiplier factors are randomly selected from separate predetermined groups. The factors are multiplied together to calculate the payoff. For each payoff, there are a predetermined number of symbol combinations corresponding thereto. One of the corresponding symbol combinations is randomly selected and displayed on the pay line. Zero payoffs are indicated by displaying a randomly selected losing combination.

7 Claims, 3 Drawing Sheets

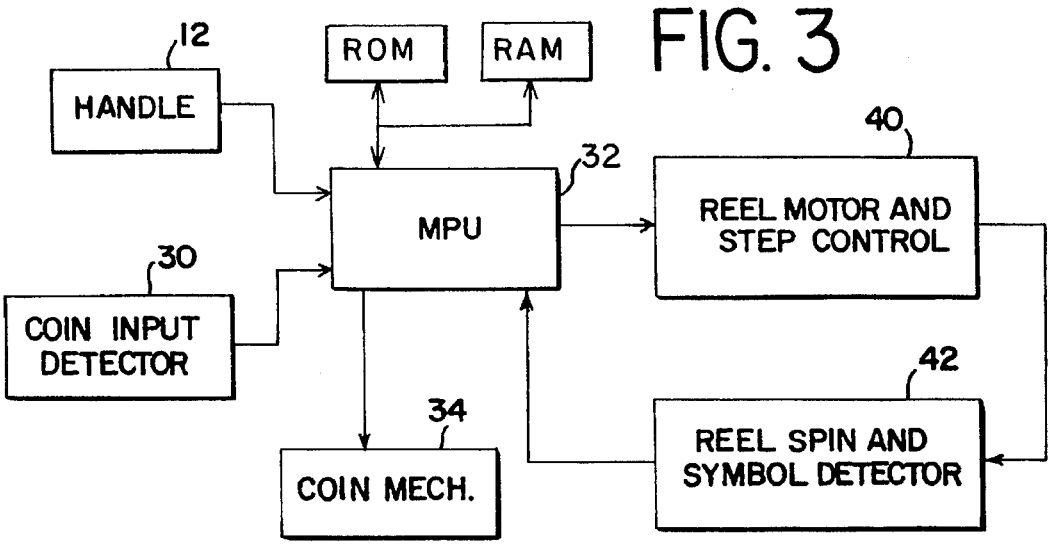
FIG. 3
12
HANDLE
ROM
RAM
MPU
32
40
REEL MOTOR AND STEP CONTROL
30
COIN INPUT DETECTOR
42
REEL SPIN AND SYMBOL DETECTOR
34
COIN MECH.

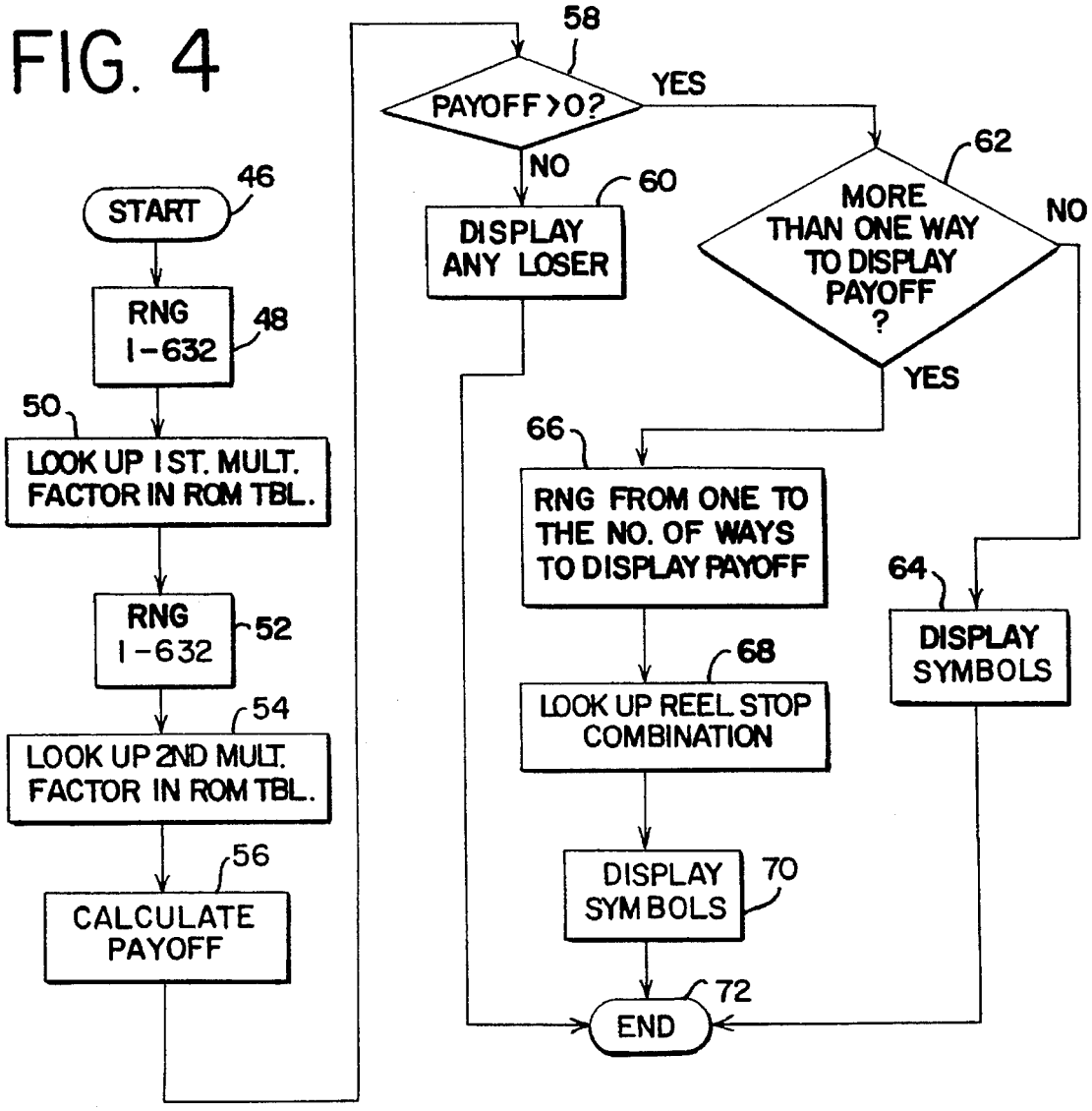
FIG. 4
46
START
RNG 1-632
48
50
LOOK UP 1ST. MULT. FACTOR IN ROM TBL.
RNG 1-632
52
54
LOOK UP 2ND MULT. FACTOR IN ROM TBL.
56
CALCULATE PAYOFF
58
PAYOFF >0?
YES
NO
60
DISPLAY ANY LOSER
62
MORE THAN ONE WAY TO DISPLAY PAYOFF ?
NO
YES
66
RNG FROM ONE TO THE NO. OF WAYS TO DISPLAY PAYOFF
64
DISPLAY SYMBOLS
68
LOOK UP REEL STOP COMBINATION
DISPLAY SYMBOLS
70
72
END

FIG. 5

| RANDOM NUMBERS | QUANTITY | MULTIPLIER "X" |
|---|---|---|
| 1 | 1 | 10 |
| 2-31 | 30 | 2 |
| 32-181 | 150 | 1 |
| 182-632 | 451 | 0 |

FIG. 6

| RANDOM NUMBERS | QUANTITY | MULTIPLIER "Y" |
|---|---|---|
| 1 | 1 | 100 |
| 2-23 | 22 | 10 |
| 24-259 | 236 | 5 |
| 260-396 | 137 | 1 |
| 397-632 | 236 | 0 |

FIG. 7

| PAYOFF "Z" VALUE | WAYS TO DISPLAY | SYMBOL COMBIN. DISPLAYED |
|---|---|---|
| 1000 | 1 | 7 7 7 |
| 200 | 1 | ≡ ≡ ≡ |
| 100 | 8 | = = = |
| 50 | 27 | — — — |
| 20 | 180 | ANY 3 BARS |
| 10 | 343 | ANY 3 BLANKS |

FIG. 8

| REEL STOP POSITIONS DISPLAYING 3 DOUBLE BARS | | | MEMORY LOCATION |
|---|---|---|---|
| 1 | 1 | 1 | A |
| 1 | 1 | 2 | B |
| 1 | 2 | 1 | C |
| 1 | 2 | 2 | D |
| 2 | 1 | 1 | E |
| 2 | 1 | 2 | F |
| 2 | 2 | 1 | G |
| 2 | 2 | 2 | H |

METHOD FOR DETERMINING PAYOFFS IN REEL-TYPE SLOT MACHINES

BACKGROUND AND SUMMARY OF THE INVENTION

The present invention generally relates to gaming apparatus and, more particularly, to electronic reel-type slot machines having a plurality of reels rotatable about a common axis. In a typical reel-type slot machine, a payoff is made to a player when a winning set of symbols is displayed on the pay line(s) of the machine. To start play, a button is pushed or a handle is pulled to begin rotation of the reels. In early designs, the angular positions of the reels, after they have been stopped, is detected and the appropriate payoff amount, if any, is calculated and paid to the player.

Another approach in modern machines uses a random number generator to select the symbols to be displayed on the pay line(s). For each reel, a stop position is randomly selected to display the symbol corresponding thereto. The payoff is then determined based on a pay table which contains payoff amounts for the various winning symbol combinations. Payoff amounts provided by this approach are limited because there is a fixed limit on the probability of obtaining the maximum payoff which is the reciprocal of the number of reel stop positions per reel raised to the power of the number of reels.

Accordingly, it is desirable to provide new ways to increase reel-type slot machine payoff values while maintaining adequate game revenue for the operator. As the payoff amounts increase, player interest in the game is fostered which leads to maximized game revenue.

One prior art method of increasing payoff values is to employ a "virtual reel". According to this method, a plurality of numbers are assigned to most of the physical reel stop positions and at least one number is assigned to every physical reel stop position. In this way, the chances of winning a larger payoff can be decreased by assigning the stop combinations corresponding to the larger payoffs to fewer numbers.

The present invention provides an alternative method for increasing payoff levels in electronic reel-type slot machines. The payoff amount—not the physical stop positions— is randomly selected from a pre-determined group of payoff values. In particular, two multiplier factors are randomly selected from two separate groups of pre-determined multiplier factors and are then multiplied together to calculate the payoff. The percentage chances of a player winning the highest payoff are controlled because there are fewer large multiplier factors and many small multiplier factors, including the factor 0.

After the amount of the payoff is determined by the random selection and multiplication of the factors, the device displays a set of symbols that correspond to the selected payoff on the pay line. Thus, for example, if a player is entitled to a 20-coin payoff as a result of the random selection of the multiplier factors 2 and 10, the control system then displays a set of symbols on the pay line which correspond to a 20 coin payoff. To do so, the control system randomly selects one of the various reel stop combinations which, according to the pay table, corresponds to a 20 coin payoff.

BRIEF DESCRIPTION OF THE DRAWINGS

FIG. 3 is a block diagram of a control system for the present invention.

FIG. 4 is a computer flow diagram illustrating a preferred embodiment of the invention.

FIGS. 5 and 6 are tables helpful in explaining the random selection of the payoff amount.

FIG. 7 is a table illustrating the various ways to display a set of symbols on the reels corresponding to a previously calculated payoff.

FIG. 8 is a table which illustrates that each reel stop combination corresponds to a unique memory location.

DETAILED DESCRIPTION OF THE PREFERRED EMBODIMENT

Figure 1:
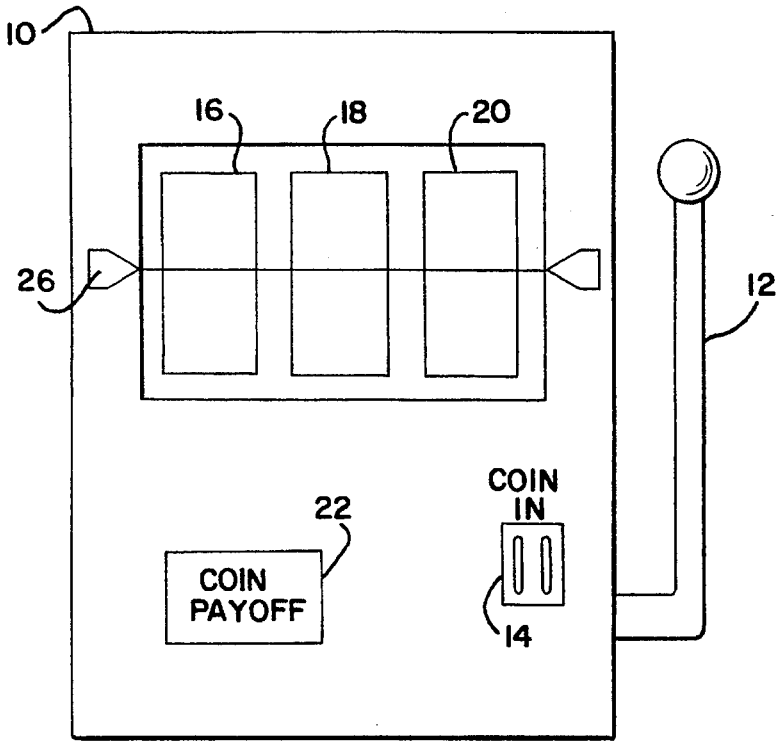
FIG. 1 shows a typical electronic reel-type slot machine which may incorporate the present invention.
Figure 2:
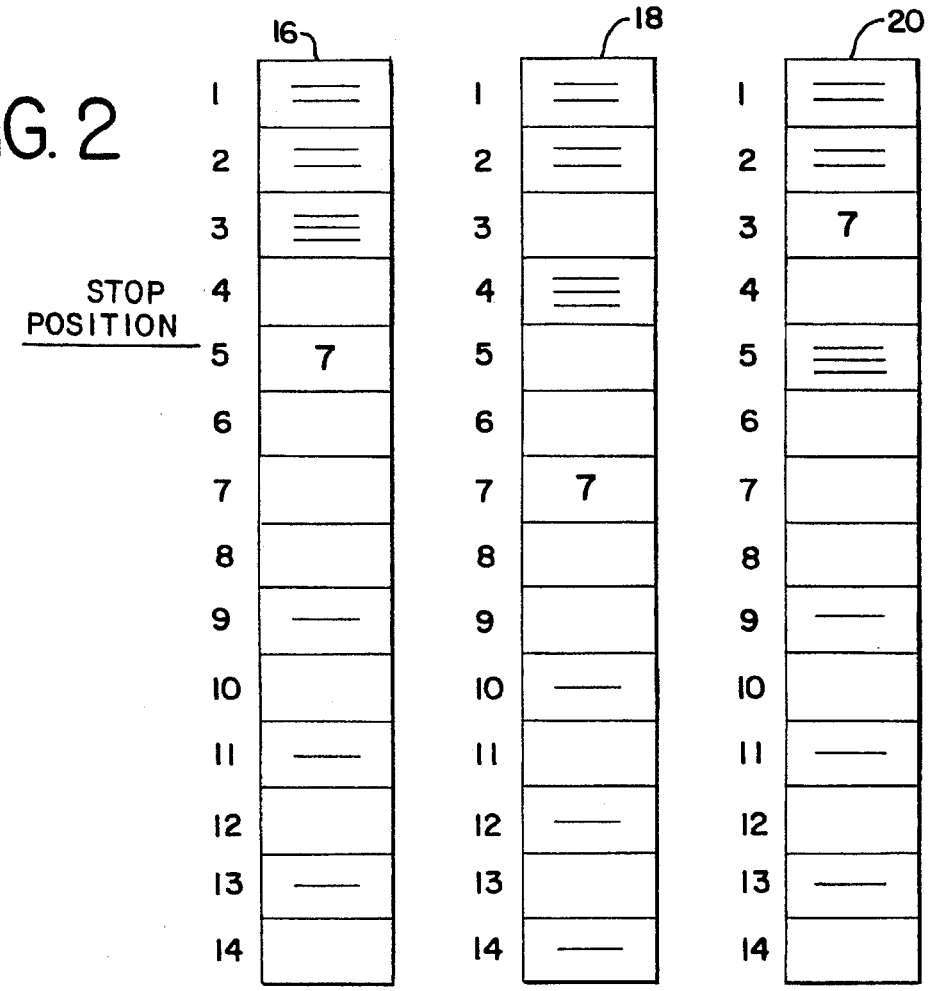
FIG. 2 illustrates three reel "strips" containing symbols positioned at the stop positions of each reel.

Referring to FIG. 1, an electronic reel-type slot machine 10 is illustrated. Slot machine 10 includes a handle 12, a coin slot 14 and typically three reels, each having a plurality of stop positions. Each reel includes a set of symbols, the symbols being utilized to display an outcome of a game which is played on slot machine 10. In the illustrated embodiment, slot machine 10 includes three slot reels 16, 18 and 20, each of which has fourteen stop positions (FIG. 2). The symbols which appear on the pay line 26 form combinations which correspond to a pay table displayed to the player. When a coin is inserted, the game start button or handle is enabled. A player will win money if a winning set of symbols is displayed on the pay line 26.

It should be noted that slot machine 10 can incorporate any number of reels and that the reels can include any number of stop positions. Any system of symbols can be utilized a long as there is one symbol, including a "blank" symbol, corresponding to each stop position on each reel.

FIG. 2 illustrates three typical reel "strips" which are secured to reels 16–20. Many variations are of course possible. In the illustrated embodiment, each reel has fourteen discrete physical stop positions. One symbol is located at each stop position. In the FIG. 2 embodiment, each of the reels 16–20 displays one "7", one triple bar, two double bars, three single bars and seven blanks in its fourteen physical stop positions.

FIG. 3 is a block diagram of a microprocessor based control system for practicing the present invention. Coin detector 30 sends a signal when a coin is inserted into coin slot 14 to a microprocessor 32. If a player wins, then microprocessor 32 signals the coin mechanism 34 (conventional) to dispense a payoff.

Reel motor and step controller 40 rotate the reels 16–20 in response to a signal from microprocessor 32. The signal is generated after a coin input and either the player pulls handle 12 or, alternatively, pushes a start button. Reel controller 40 stops the reels at positions determined by the microprocessor as discussed hereafter such that the reels display three symbols on the pay line 26.

The reel stop combinations displayed correspond to a previously calculated payoff. To ensure that the appropriate reel stop combination is displayed, detector 44 provides closed-loop feedback signals to microprocessor 32 which are representative of the rotational position of each reel relative to pay line 26. This type of closed-loop feedback is utilized in accordance with well known techniques in this art.

FIG. 4 is a computer flow diagram which illustrates the steps executed by the microprocessor to practice the present invention. The steps of FIG. 4 are provided in the form of a computer program stored in a read only memory, or ROM. The program is executed by microprocessor 32 when the game is played. Current game data is stored in a random access memory, or RAM, associated with microprocessor 32. FIG. 4 is a flow diagram which illustrates the essential program steps of the invention, thereby permitting the present invention to be programmed on any type of computer system desired.

The program begins at start step 46. The RNG or random number generator function of microprocessor 32 is used to randomly select first and second multiplier factors, X and Y, from two pre-determined random number pools (steps 48–54). In the embodiment illustrated in FIGS. 5 and 6, for exemplary purposes, the microprocessor 32 randomly selects an integer ranging from 1 to 632 to determine a first multiplier, X. The randomly generated integer is used to identify the multiplier from a look-up table stored in ROM. A similar RNG cycle is used to determine the second multiplier factor, Y.

FIGS. 5 and 6 are representative of the ROM look-up tables used for determining the multiplier factors X and Y. If, for example, the RNG selects any number between 2 and 31, then X would have a value of 2. Similarly, if any number between 182 and 632 is selected, X would have the value zero. Thus, in steps 50 and 54, microprocessor 32 uses the randomly generated numbers as indices to look up the values of the X and Y multiplier factors in the corresponding look-up ROM tables. Next, step 56, the payoff is calculated. For example, if the randomly selected X and Y multiplier factors have values of 2 and 10, respectively, then the payoff amount, Z is determined as 2 times 10 or 20 units.

The amount of coins to be paid to the player, Z, is calculated in step 56 by multiplying X and Y factors together. In the illustrated embodiment, the possible Z payoff values are illustrated in FIG. 7. It should be noted that the payoff value Z is calculated before any reel stop positions are selected.

Referring again to FIG. 4, if the payoff value is not greater than zero (i.e., X times Y equals zero), then the reels are caused to display a losing symbol combination, steps 58 and 60. The number of losing symbol combinations is finite and easily calculated given the number of reels and the number of symbols per reel. Each losing combination corresponds to a number in another look-up table in the ROM. One of the losing symbol combinations is randomly selected by microprocessor 32 by simply choosing one of the numbers. The reels 16–20 are then stopped by controller 40 to display the losing combination and the program ends, step 72.

In the case where the payoff is greater than zero, the program proceeds to step 62. At least one set of winning symbols corresponds to each of the Z payoff values as shown in FIGS. 7 and 8. For example, three "7s" are displayed if a payoff of 1,000 units is selected. Similarly, three double bars are displayed if the payoff is to be 100 units, three single bars are displayed if the payoff is 50 units and so on.

If there is only one way to display the winning Z value, as determined in step 62, then the controller 40 stops the reels at that reel stop combination. The program then ends at step 72.

It will be noted from FIG. 2 that in many cases there are duplicate symbols on each reel which can be utilized to display some Z values. Thus, for example, each of the reel strips of FIG. 2 contain double bars at stop positions 1 and 2. Therefore, there are eight unique stop position combinations that will result in the player seeing three double bars on the pay line.

If the number of ways to display a winning combination is greater than one, then the particular reel stop combination used to display the winning Z value must be determined. To do so, the microprocessor 32 randomly selects one of the possible ways to display the winning Z value at step 66. FIG. 7 is a partial list of typical Z values and lists the number of discrete reel stop combinations which correspond thereto.

To illustrate the point, if Z is 100 units, then microprocessor 32 must display three double bars on the pay line 26. As FIG. 7 indicates, there are eight distinct stop position combinations that will do so based on the reel strip arrangement of FIG. 2. In that case, microprocessor 32 will randomly select a number from 1 to 8 in step 66 to determine which combination is displayed. This adds an element of apparent randomness to the game.

The randomly generated number of step 66 is used as an index to look up one of the reel stop combinations in a ROM lookup table, step 68. That table contains the various reel stop combinations corresponding to a particular Z value. Each reel stop combination is mapped to a unique memory location in ROM. The randomly selected reel stop combination is then displayed on the reels 16–20 in step 70. The program ends at step 72.

For example, with reference to FIG. 8, it can be seen that the eight reel stop combinations for displaying three double bars are mapped to eight unique memory locations designated A–H. In step 68, microprocessor 32 randomly selects a number from one to eight. If the fourth memory location, location D, is selected, then the three reels 16–20 will be stopped at physical stop positions 1, 2, 2, respectively. If the eight memory location, location H, is randomly selected, then the reels will instead be stopped at physical stop positions 2, 2 and 2. In this embodiment, each memory location is associated with one and only one physical reel stop combination.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of operating a slot machine having a plurality of reels each rotatable about an axis through a fixed number of stop positions, said reels having viewable symbols located at each stop position for display on a pay line, said method comprising the steps of:

a) randomly selecting at least two multiplier values, each of which is an integer;

b) multiplying the multiplier values together to obtain a payout amount Z;

c) determining if Z is zero; and (i) if Z is zero, displaying a randomly selected losing symbol combination on the pay line;

(ii) if Z is not zero, displaying a winning symbol combination on the pay line, said winning symbol combination being randomly selected from a set of combinations corresponding to the payout amount Z.

2. The method of claim 1 wherein two multiplier values are randomly selected and multiplied together to obtain the payout amount Z.

3. The method of claim 1 wherein more than two multiplier values are randomly selected and multiplied together to obtain the payout amount Z.

4. The method of claim 1 wherein each multiplier value is an integer greater than or equal to zero.

5. The method of claim 1 wherein each multiplier value is randomly selected from a group of possible values, the odds of picking a particular value from said group being unequal.

6. The method of claim 1 wherein step c (i) includes the substeps of:

(a) storing each of said losing symbol combinations in a look-up table; and (b) randomly selecting one of said losing symbol combinations from the look-up table for display on the pay line.

7. The method of claim 1 further including the step of storing each winning symbol combination in a look-up table according to the Z value to which it corresponds and wherein step c (ii) includes the substeps of:

(a) determining the number of winning symbol combinations that exist for a selected value Z;

(b) if the number of winning symbol combinations in the look-up table is greater than 1, randomly selecting one of the winning symbol combinations for the selected Z value; and (c) displaying the selected winning symbol combination on the pay line.

* * * * *